United States Patent [19]

Cier et al.

[11] 4,025,446

[45] May 24, 1977

[54] LUBRICANT COMPOSITIONS CONTAINING NITRILE ANTIWEAR ADDITIVES

[75] Inventors: Ronald J. Cier, East Windsor; Robert F. Bridger, Hopewell, both of N.J.

[73] Assignee: Mobil Oil Corporation, New York, N.Y.

[22] Filed: Dec. 10, 1975

[21] Appl. No.: 639,548

[52] U.S. Cl. ..... 252/51.5 R

[51] Int. Cl.[2] ..... C10M 1/32

[58] Field of Search ..... 252/50, 51.5 R

[56] References Cited

UNITED STATES PATENTS

| | | | |
|---|---|---|---|
| 2,053,045 | 9/1936 | Ralston et al. | 252/50 |
| 2,125,851 | 8/1938 | Ralston | 252/50 |
| 2,454,394 | 11/1948 | Lieber et al. | 252/50 |
| 2,765,333 | 10/1956 | Lane et al. | 252/51.5 R X |
| 2,818,422 | 12/1957 | Heininger | 252/51.5 R X |
| 2,836,613 | 5/1958 | Heininger | 252/51.5 R X |
| 3,136,783 | 6/1964 | Stenberg | 252/51.5 R X |
| 3,223,631 | 12/1965 | Morway et al. | 252/50 X |

*Primary Examiner*—Delbert E. Gantz
*Assistant Examiner*—Andrew H. Metz
*Attorney, Agent, or Firm*—Charles A. Huggett; Raymond W. Barclay; Howard M. Flournoy

[57] ABSTRACT

Lubricant compositions are provided, containing an antiwear amount of a compound having the structure $Y(CN)_n$ in which $n$ is a whole number from 2 to 6 and when $n$ is 2, Y is alkylene, phenylene or benzylene, when $n$ is 3, Y is a tris(ethyleneoxy) paraffin having from 3 to 12 carbon atoms, when $n$ is 4, Y is a tetrakis-(ethyleneoxy) paraffin having from 4 to 12 carbon atoms, when $n$ is 5, Y is a pentakis(ethyleneoxy) paraffin having from 5 to 16 carbon atoms, and when $n$ is 6, Y is a hexakis(ethyleneoxy) cycloparaffin having from 6 to 16 carbon atoms.

12 Claims, No Drawings

LUBRICANT COMPOSITIONS CONTAINING NITRILE ANTIWEAR ADDITIVES

BACKGROUND OF THE INVENTION

1. Field of the Invention

This invention relates to lubricant compositions, and, in one of its aspects, relates more particularly to improved lubricant compositions in the form of lubricating oils and greases, which normally require improvement in antiwear properties.

2. Description of the Prior Art

It is well known that certain types of lubricant compositions, particularly oils of lubricating viscosities and greases, normally exhibit poor antiwear properties during the course of their performance. In this respect, antiwear additives of the prior art have not exhibited satisfactory antiwear properties in conjunction with low corrosivity to steel, bronze, and other metals. Such metals, are further exemplified in a wide variety of industrial lubricant applications including worm gear sets (steel/bronze), table slides (steel/ bronze) and hydraulic pumps (steel/brass or silver/bronze).

SUMMARY OF THE INVENTION

It has now been found that improvement in antiwear properties of lubricant compositions, particularly lubricating oils and grease, can be realized by incorporating in these compositions a compound having the structure $Y(CN)_n$ in which $n$ is a whole number from 2 to 6 and when $n$ is 2, Y is alkylene, particularly those having from 2 to 16 carbon atoms, phenylene or benzylene, when $n$ is 3, Y is a tris(ethyleneoxy) paraffin having from 3 to 12 carbon atoms, when $n$ is 4, Y is tetrakis-(ethyleneoxy) paraffin having from 4 to 12 carbon atoms, when $n$ is 5, Y is pentakis(ethyleneoxy) paraffin having from 5 to 16 carbon atoms, and when $n$ is 6, Y is hexakis(ethylenoxy) cycloparaffin having from 6 to 16 carbon atoms. More particularly, in more specific aspects, when $n$ is 3, Y is tri(ethyleneoxy) propane, when $n$ is 4, Y is tetrakis(ethyleneoxy) butane, when $n$ is 5, Y is pentakis(ethyleneoxy) pentane and $n$ is 6, Y is hexakis(ethyleneoxy) cyclohexane.

DESCRIPTION OF SPECIFIC EMBODIMENTS

In general, the present invention, in its preferred applications, contemplates lubricants compositions of the above-described types which contain a small amount sufficient to impart antiwear properties of the aforementioned cyano additives. Generally, for most applications, the additive is present in an amount from about 0.1 to about 5%, by weight, and preferably in an amount from about 0.1 to about 1%, by weight. The lubricant compositions contemplated in accordance with the present invention may comprise any materials that normally exhibit insufficient antiwear properties. A field of specific applicability is the improvement of liquid hydrocarbon oils boiling within the range from about 75° F to about 1,000° F. Lubricant oils, improved in accordance with the present invention, may be of any suitable lubricating viscosity range from about 45 SSU at 100° F to about 6,000 SSU at 100° F and, preferably, from about 50 to 250 SSU at 210° F. These oils having viscosity indexes from about 70 to about 95 are preferred. The average molecular weights of these oils may range from about 250 to about 800. In general, the lubricant may comprise any mineral or synthetic oil of lubricating viscosity.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorous-containing acids, liquid ureas, ferrocene derivatives, hydrogenated mineral oils, chain-type polyphenyls, siloxanes and silicones (polysiloxanes), alkyl-substituted diphenyl ethers typified by a butyl-substituted bis (p-phenoxy phenyl) ether, phenoxy phenylethers, etc.

As hereinbefore indicated, the aforementioned additives may be incorporated a antiwear agents in grease compositions. Such oils can also include hydraulic oils, if so desired. When high temperature stability is not a requirement of the finished grease, mineral oils having a viscosity of at least 40 SSU at 150° F, and particularly those falling within the range from about 60 SSU to about 6,000 SSU at 100° F may be employed. The lubricating vechiles of the improved greases of the present invention, containing the above-described additives, are combined with a grease-forming quantity of a thickening agent. For this purpose, a wide variety of materials dispersed in the lubricating vehicle in grease-forming quantities in such degree as to impart to the resulting grease composition the desired consistency. Exemplary of the thickening agents that may be employed in the grease formultion are non-soap thickneners, such as surface-modified clays and silicas, aryl ureas calcium complexes and similar materials. In general, grease thickeners may be employed which do not melt and dissolve when used at the required temperature within a particular environment; however, in all other respects, any material which is normally employed for thickening or gelling hydrocarbon fluids or forming greases can be used in preparing the aforementioned improved greases in accordance with the present invention.

EXAMPLES AND EVALUATION THEREOF

Having described the invention in general terms, the matter following provides examples of the cyano derivatives and antiwear data showing their utility. All compounds used were obtained from commercial sources. It will be understood that it is not intended the invention be limited to the particular antiwear additives as described, and that various modifications thereof can be employed and will be readily apparent to those skilled in the art.

The additives were tested for antiwear activity using the Four Ball Wear Test, disclosed in U.S. Pat. No. 3,423,316. In general, in this test three steel balls of SAE 52100 steel are held in a ball cup. A fourth ball positioned on a rotatable vertical axis is brought into contact with the three balls and is rotated against them. The force with which the fourth is held against the three stationary balls may be varied according to a desired load. The test lubricant is added to the ball cup and acts as a lubricant for the rotation. At the end of the test, the steel balls are investigated for wear scar; the extent of scarring represents the effectiveness of the lubricant as an antiwear agent. Results are also reported as wear rates in volume of wear per unit sliding distance per kilogram load. The lower the wear rate, the more effective the lubricant as an antiwear agent. The base stock oil employed in accordance with the test results shown in Table I comprises a 150 SSU at 210° F solvent-refined paraffinic bright stock lubricating oil. In the data summarized in Table 1, additives were tested at equimolar concentrations of 0.02 moles per kilogram of oil; the corresponding weight percentages are shown in the table. Standard conditions of 40 kg load, 600 rpm, and 30 minutes' test time were employed at 200° F and 400° F.

TABLE 1

Four Ball Wear Test Results
40 kg load, 600 rpm, 30 minutes

| Ex. | Compound | Wt.% | 200° F Coefficient of Friction | 200° F Wear Scar Diameter mm | 200° F Wear Scar $\times 10^{-12}$cc/cm-kg |
|---|---|---|---|---|---|
| — | Base Stock only | — | 0.087 | 0.686 | 4.60 |
| 1 | 1,4-Dicyanobutane | 0.22 | 0.090 | 0.577 | 2.16 |
| 2 | 1,5-Dicyanopentane | 0.24 | 0.084 | 0.538 | 1.57 |
| 3 | 1,2-Dicyanobenzene | 0.26 | 0.080 | 0.533 | 1.51 |
| 4 | 1,3-Dicyanobenzene | 0.26 | 0.086 | 0.546 | 1.68 |
| 5 | 1,4-Dicyanobenzene | 0.26 | 0.078 | 0.528 | 1.44 |
| 6 | α-Cyano-0-tolunitrile | 0.28 | 0.082 | 0.521 | 1.35 |
| 7 | 1,2,3,4-Tetrakis-(2-cyanoethoxy)butane<br>$CH_2-O-CH_2CH_2C\equiv N$<br>\|<br>$CH-O-CH_2CH_2C\equiv N$<br>\|<br>$CH-O-CH_2CH_2C\equiv N$<br>\|<br>$CH_2O-CH_2CH_2C\equiv N$ | 0.67 | 0.093 | 0.635 | 3.30 |
| 8 | 1,2,3,4,5,6-Hexakis-(2-cyanoethoxy)cyclohexane<br>$O-CH_2CH_2C\equiv N$<br>$N\equiv CCH_2CH_2-O$ $O-CH_2CH_2C\equiv N$<br>$N\equiv CCH_2CH_2-O$ $O-CH_2CH_2C\equiv N$<br>$O-CH_2CH_2C\equiv N$ | 1.0 | 0.090 | 0.584 | 2.28 |
| 9 | 1,2-Dicyanoethane<br>$N\equiv C-(CH_2)_2-C\equiv N$ | 0.16 | 0.086 | 0.407 | 0.38 |
| 10 | 1,10-Dicyanodecane<br>$N\equiv C-(CH_2)_{10}-C\equiv N$ | 0.38 | .102 | 0.533 | 1.51 |

| Example | Wt.% | 400° F Coefficient of Friction | 400° F Wear Scar Diameter mm | 400° F Wear Rate $\times 10^{-12}$cc/cm-kg |
|---|---|---|---|---|
| Base stock only | — | 0.159 | 0.834 | 10.5 |
| 1 | 0.22 | 0.096 | 0.445 | 0.62 |
| 2 | 0.24 | 0.093 | 0.457 | 0.71 |
| 3 | 0.26 | 0.094 | 0.432 | 0.53 |
| 4 | 0.26 | 0.080 | 0.424 | 0.48 |
| 5 | 0.26 | 0.083 | 0.432 | 0.53 |
| 6 | 0.28 | 0.098 | 0.445 | 0.62 |
| 7 | 0.67 | 0.091 | 0.432 | 0.53 |
| 8 | 1.0 | 0.086 | 0.432 | 0.53 |
| 9 | 0.16 | 0.094 | 0.424 | 0.48 |
| 10 | 0.38 | 0.093 | 0.432 | 0.53 |

As will be apparent from the data of the foregoing Table 1, the lubricant compositions of the present invention exhibit highly improved antiwear properties, as evidenced by the indicated comparative data with respect to wear scar diameter and wear rate.

While the present invention has been described with reference to preferred compositions and modifications thereof, it will be apparent to those skilled in the art that departure from the preferred embodiments can be effectively made and are within the scope of the specification.

We claim:

1. A lubricant composition comprising a major proportion of a lubricant consisting essentially of an oil of lubricating viscosity or grease prepared therefrom and a minor antiwear amount of a compound having the structure Y(CN)n is which *n* is a whole number from 3 to 6 and when *n* is 3, Y is a tris(ethyleneoxy) paraffin having from 3 to 12 carbon atoms, when *n* is 4, Y is a tetrakis(ethyleneoxy) paraffin having from 4 to 12 carbon atoms, when *n* is 5 Y is a pentakis(ethyleneoxy) paraffin having from 5 to 16 carbon atoms, and when *n* is 6, Y is a hexakis(ethyleneoxy) cycloparaffin having from 6 to 16 carbon atoms.

2. The lubricant composition defined in claim 1 wherein the additive is 1,2,3-tris-(2-cyanoethoxy) propane.

3. The lubricant composition defined in claim 1 wherein the additive is 1,2,3,4-tetrakis-(2-cyanoethoxy) butane.

4. The lubricant composition defined in claim 1 wherein the additive is 1,2,3,4,5-pentakis-(2-cyanoethoxy) pentane.

5. The lubricant composition defined in claim 1 wherein the additive is 1,2,3,4,5,6-hexakis-(2-cyanoethoxy) cyclohexane.

6. The lubricant composition defined in claim 1 wherein the antiwear compound is present in an amount from about 0.05 to about 5%, by weight.

7. The lubricant composition defined in claim 1 wherein the antiwear compound is present in an amount from about 0.1 to about 2%, by weight.

8. The lubricant composition defined in claim 1 wherein said lubricant comprises an oil of lubricating viscosity.

9. The lubricant composition defined in claim 1 wherein said lubricant comprises a mineral oil.

10. The lubricant composition defined in claim 1 wherein said lubricant comprises a synthetic oil.

11. The lubricant composition defined in claim 1 wherein said lubricant comprises a hydraulic oil.

12. The lubricant composition defined in claim 1 wherein said lubricant comprises a grease.

* * * * *